US010822737B2

(12) United States Patent
Park et al.

(10) Patent No.: US 10,822,737 B2
(45) Date of Patent: Nov. 3, 2020

(54) WASHING MACHINE

(71) Applicant: SAMSUNG ELECTRONICS CO., LTD., Suwon-si (KR)

(72) Inventors: Jae Seuk Park, Yongin-si (KR); Boo Keun Yoon, Suwon-si (KR); Jeoung Kyo Jeoung, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 293 days.

(21) Appl. No.: 15/934,156

(22) Filed: Mar. 23, 2018

(65) Prior Publication Data

US 2018/0274154 A1 Sep. 27, 2018

(30) Foreign Application Priority Data

Mar. 24, 2017 (KR) ..... 10-2017-0037804

(51) Int. Cl.

*D06F 35/00* (2006.01)
*D06F 39/02* (2006.01)
*D06F 39/08* (2006.01)

(52) U.S. Cl.

CPC ..... *D06F 35/002* (2013.01); *D06F 39/028* (2013.01); *D06F 39/02* (2013.01); *D06F 39/088* (2013.01); *D06F 2202/085* (2013.01); *D06F 2204/086* (2013.01)

(58) Field of Classification Search

CPC ..... D06F 35/002; D06F 39/028; D06F 39/02; D06F 39/088; D06F 2202/085; D06F 2204/086

USPC ..... 68/183

See application file for complete search history.

(56) References Cited

U.S. PATENT DOCUMENTS 5,253,380 A * 10/1993 Lim ..... D06F 17/12 8/158
5,473,914 A 12/1995 Pyo et al.

FOREIGN PATENT DOCUMENTS

| | | | |
|---|---|---|---|
| CN | 105506922 | | 4/2016 |
| CN | 105544147 | | 5/2016 |
| JP | 2009-178195 | A | 8/2009 |
| JP | 2016-7308 | A | 1/2016 |
| KR | 20-0153251 | Y1 | 8/1999 |
| KR | 10-2000-0045029 | A | 7/2000 |
| KR | 10-2010-0106037 | | 10/2010 |
| KR | 10-2011-0008838 | | 1/2011 |
| KR | 10-2011-0027282 | | 3/2011 |
| KR | 10-2012-0073564 | | 7/2012 |
| KR | 10-2013-0143474 | | 12/2013 |
| KR | 10-1568209 | B1 | 11/2015 |

OTHER PUBLICATIONS

JP2009178195A—Machine translation (Year: 2009).*
KR20000045029A—Machine translation (Year: 2000).*
Patent Abstract of Korean Publication No. 10-2015-0074324.

(Continued)

*Primary Examiner* — Tinsae B Ayalew
(74) *Attorney, Agent, or Firm* — Staas & Halsey LLP

(57) ABSTRACT

A washing machine including a bubble generator. The washing machine includes a detergent box configured to store a detergent, a detergent box housing configured to accommodate the detergent box therein and a bubble generator to generate bubbles to be supplied and configured to mix water supplied to the detergent box with air.

10 Claims, 13 Drawing Sheets

(56) References Cited

OTHER PUBLICATIONS

International Search Report dated Jun. 28, 2018 in corresponding International Patent Application No. PCT/KR2018/003145, 3 pgs.
Extended European Search Report dated Dec. 19, 2019 in European Patent Application No. 18771926.5.

* cited by examiner

WASHING MACHINE

CROSS-REFERENCE TO RELATED APPLICATION

This application is based on and claims priority under 35 U.S.C. § 119 to Korean Patent Application No. 10-2017-0037804, filed on Mar. 24, 2017 in the Korean Intellectual Property Office, the disclosure of which is incorporated by reference herein in its entirety.

BACKGROUND

1. Field

The disclosure relates to a washing machine, and more particularly, to a washing machine including a bubble generator.

2. Description of the Related Art

Generally, a washing machine (generally, a drum washing machine) includes a tub in which wash water is stored, a drum rotatably installed in the tub and configured to accommodate laundry, and a driving motor configured to generate a driving force for rotating the drum.

The washing machine is an apparatus in which a drum rotates due to a driving force of a driving motor and washes laundry by generating a frictional force while the laundry, wash water, and a detergent are inserted.

The washing machine performs washing through a series of operations which includes a washing operation of separating contaminants from laundry using water in which a detergent is dissolved, that is, wash water, a rinsing operation of rinsing bubbles or the residual detergent of the laundry using water which does not include a detergent, that is, rinsing water, and a spin-drying operation of dehydrating the laundry at a high speed. Washing is performed by inserting a detergent and water together into a tub and transferring the water and the detergent to the laundry and dropping the laundry via rotation of a drum.

Recently, a washing machine including a bubble generator configured to generate bubbles by mixing wash water with air is being used for more efficient washing.

SUMMARY

It is an aspect of the present disclosure to provide a washing machine configured to have an improved structure capable of securing efficient washing performance while minimizing damage to laundry.

Additional aspects of the present disclosure will be set forth in part in the description which follows and, in part, will be obvious from the description, or may be learned by practice of the disclosure.

In accordance with an aspect of the present disclosure, a washing machine may include a detergent box configured to store a detergent, a detergent box housing configured to accommodate the detergent box therein and a bubble generator configured to generate bubbles to be supplied by mixing water with air.

In accordance with an aspect of the present disclosure, the washing machine may further include a water supply pipe configured to supply water to the detergent box. The bubble generator may be disposed between the water supply pipe and the detergent box housing to supply the generated bubbles.

The bubble generator may include a first flow path pipe connected to the water supply pipe, a second flow path pipe connected to the detergent box housing and a connection pipe configured to connect the first flow path pipe to the second flow path pipe and to have a diameter smaller than those of the first flow path pipe and the second flow path pipe.

The bubble generator may further include an air inflow pipe connected to the connection pipe to supply the air to the bubble generator therethrough.

The bubble generator may further include a perforated plate disposed at the second flow path pipe.

The bubble generator may be disposed above the detergent box housing.

The bubble generator may include a plurality of bubble generation units arranged in parallel. Each of the plurality of bubble generation units may include a first flow path pipe into which the water flows, a second flow path pipe from which the water is discharged and a connection pipe configured to connect the first flow path pipe to the second flow path pipe and to have a diameter smaller than those of the first flow path pipe and the second flow path pipe.

Each of the plurality of bubble generation units may further include an air inflow port configured to communicate with the connection pipe to supply the air therethrough.

The detergent box housing may include a detergent box accommodation body in which the detergent box is insertable to the detergent box accommodation body and withdrawable from the detergent box accommodation body and a detergent box cover coupled to a top of the detergent box accommodation body. The bubble generator may include a perforated plate disposed at one side of the detergent box cover configured to face the detergent box accommodation body.

In accordance with an aspect of the present disclosure, the washing machine may further include a water pressure increasing device configured to increase water pressure of the water supplied to the bubble generator.

In accordance with another aspect of the present disclosure, a washing machine may include a tub, a water supply device configured to supply wash water to the tub, a detergent supply device configured to supply a detergent to the tub, a first water supply flow path located on an upper stream side in a direction, in which the wash water supplied by the water supply device moves, and configured to connect the water supply device to the detergent supply device, a second water supply flow path located on a downstream side in the direction, in which the wash water supplied by the water supply device moves, and configured to connect the detergent supply device to the tub and a bubble generator disposed at the first water supply flow path to generate bubbles using the wash water supplied by the water supply device.

The bubble generator may include a first flow path pipe connected to the water supply pipe, a second flow path pipe connected to the detergent supply device and a connection pipe configured to connect the first flow path pipe to the second flow path pipe and to have a diameter smaller than those of the first flow path pipe and the second flow path pipe.

In accordance with another aspect of the present disclosure, the washing machine may further include an air flow path configured to connect the detergent supply device to the connection pipe to allow air to flow into the bubble generator.

The bubble generator may further include a perforated plate disposed in the bubble generator and configured to comprise a plurality of openings.

The bubble generator may be separably disposed.

In accordance with still another aspect of the present disclosure, a washing machine may include a tub, a water supply device configured to supply wash water to the tub, a detergent supply device disposed between the water supply device and the tub in a direction in which the wash water supplied by the water supply device moves, to supply a detergent to the tub and configured to comprise a detergent box in which the detergent is accommodated, a detergent box accommodation body configured to accommodate the detergent box, and a detergent box cover coupled to the detergent box accommodation body and a bubble generator disposed between the water supply device and the detergent supply device in the direction in which the wash water supplied by the water supply device moves, to generate bubbles using the wash water supplied by the water supply device and configured to comprise one or more bubble generation units arranged in the detergent box cover.

BRIEF DESCRIPTION OF THE DRAWINGS

These and/or other aspects of the present disclosure will become apparent and more readily appreciated from the following description of the embodiments, taken in conjunction with the accompanying drawings of which.

DETAILED DESCRIPTION

Hereinafter, exemplary embodiments of the present disclosure will be described in detail with reference to the attached drawings. Meanwhile, the terms used herein such as "a front end," "a rear end," "a top," "a bottom," "a top end," "a bottom end," and the like are defined on the basis of the drawings, and shapes and positions of components are not restricted by the terms.

Hereinafter, "wash water" may be used as a term which includes water supplied by a water supply device, water in which a detergent is dissolved, and the like.

Hereinafter, bubbles will be referred to as B.

Figure 1:
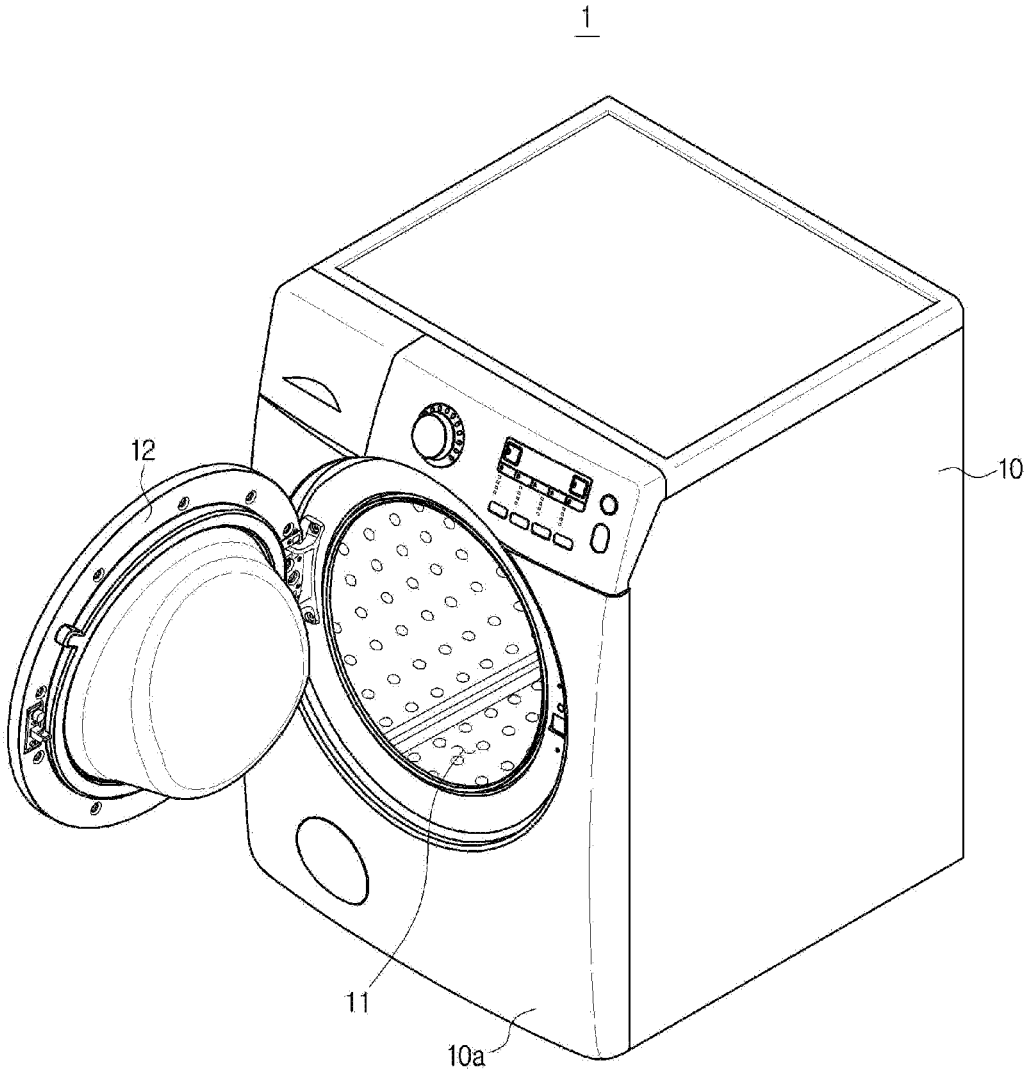
FIG. 1 is a perspective view of a washing machine according to an embodiment of the present disclosure.
Figure 2:
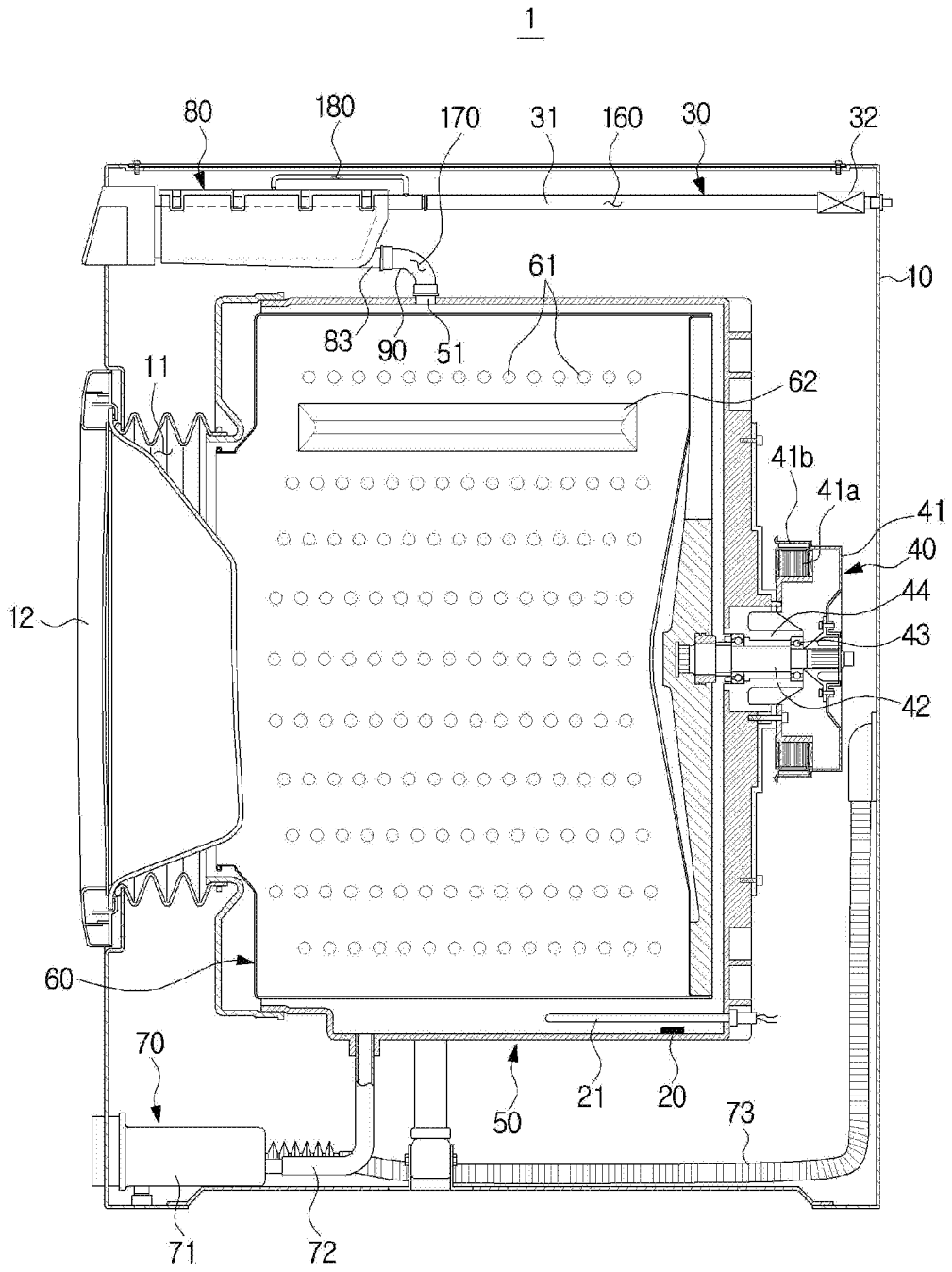
FIG. 2 is a cross-sectional view of the washing machine according to an embodiment of the present disclosure.

FIG. 1 is a perspective view of a washing machine according to an embodiment of the present disclosure, and FIG. 2 is a cross-sectional view of the washing machine according to an embodiment of the present disclosure. FIG. 2 illustrates a case in which a bubble generator 100 according to a first embodiment is applied. However, FIG. 2 illustrates a case in which an air inflow pipe 600 connects the bubble generator 100 with a detergent supply device 80.

As shown in FIGS. 1 and 2, a washing machine 1 may include a body 10 configured to form an exterior.

The washing machine 1 may further include a tub 50 installed inside the body 10 and configured to accommodate wash water while washing.

The washing machine 1 may further include a drum 60 rotatably installed in the tub 50 and configured to include a plurality of communicating holes 61. A lifter 62 for lifting laundry upward may be disposed in the drum 60.

An inlet 11 may be formed at a front surface 10*a* to insert laundry into the drum 60.

The washing machine 1 may further include a door 12 rotatably installed at the body 10 to open or close the inlet 11.

The washing machine 1 may further include a heater 21 configured to heat wash water in the tub 50. The heater 21 may be installed at a bottom portion of the tub 50.

The washing machine 1 may further include a water level sensor 20 installed to detect a frequency which varies according to a water level in order to sense a water level of wash water in the drum 60.

The washing machine 1 may further include a water supply device 30 configured to supply wash water to the tub 50. The water supply device 30 may be installed at a top portion of the body 10. In other words, the water supply device 30 may be disposed above the tub 50.

The washing machine 1 may further include a detergent supply device 80 configured to supply a detergent to the tub 50. The detergent supply device 80 may be installed at the top portion of the body 10. The detergent supply device 80 may be disposed between the water supply device 30 and the tub 50 in a direction in which wash water supplied by the water supply device 30 moves, in order to supply a detergent to the tub 50. The detergent supply device 80 may include a detergent box 81 (refer to FIG. 3) configured to accommodate a detergent and a detergent box housing 82 (refer to FIG. 3) configured to accommodate the detergent box 81. The detergent box housing 82 may include a detergent box accommodation body 82*b* (refer to FIG. 3) in which the detergent box 81 is accommodated to be withdrawable and a detergent box cover 82*a* (refer to FIG. 3) coupled to the detergent box accommodation body 82*b*. The detergent box accommodation body 82*b* and the detergent box cover 82*a* may be coupled to each other to form a detergent box accommodation space in which the detergent box 81 can be accommodated. The detergent box cover 82*a* may be coupled to the detergent box accommodation body 82*b* to be located above the detergent box accommodation body 82*b*. The detergent box cover 82*a* may be separably coupled to the detergent box accommodation body 82*b*.

The water supply device 30 may include a water supply valve 32 connected to an external water source (not shown)

configured to control water supply and a water supply pipe 31 configured to connect the water supply valve 32 to the detergent supply device 80.

Wash water supplied by the water supply device 30 may pass through the detergent supply device 80 and may be supplied with a detergent to an inside of the tub 50 through a guide pipe 90. The guide pipe 90 may connect an outlet pipe 83 configured to protrude from the detergent supply device 80 to an inlet pipe 51 configured to protrude from the tub 50.

The washing machine 1 may further include a driving device 40 configured to rotate the drum 60. The driving device 40 may be installed on an outer surface of a rear side of the tub 50. The driving device 40 may include a driving motor 41, a driving shaft 42 configured to transfer a rotating force of the driving motor 41 to the drum 60 between the drum 60 and the driving motor 41, a bearing housing 44 installed on a rear surface plate of the tub 50 to rotatably support the driving shaft 42, and a bearing 43 installed between the bearing housing 44 and the driving shaft 42. The driving motor 41 may include a stator 41*a* installed at the tub 50 and a rotor 41*b* configured to rotate while interacting with the stator 41*a*. One end of the driving shaft 42 may be installed on the rotor 41*b* and the other end thereof may pass through a rear surface of the tub 50 and be installed on the drum 60 such that the driving shaft 42 rotates with the rotor 41*b* to rotate the drum 60.

The washing machine 1 may further include a drainage device 70 configured to discharge wash water from the tub 50. The drainage device 70 may be installed at a bottom portion of the body 10. In other words, the drainage device 70 may be disposed below the tub 50. The drainage device 70 may include a pump 71 which absorbs wash water in the tub 50, a first drain pipe 72 configured to connect the tub 50 to the pump 71 to guide the wash water in the tub 50 to the pump 71, and a second drain pipe 73 connected to the pump 71 and configured to extend outward from the body 10 to discharge the wash water.

The washing machine 1 may further include a bubble generator 100 configured to generate bubbles using wash water supplied by the water supply device 30. That is, the bubble generator 100 may convert wash water supplied by the water supply device 30 into bubbles. In other words, the bubble generator 100 may be configured to mix air with water supplied to the detergent box 81. The bubble generator 100 may be disposed between the water supply device 30 and the detergent supply device 80 in the direction in which wash water supplied by the water supply device 30 moves, in order to generate bubbles using the wash water supplied by the water supply device 30.

The washing machine 1 may include at least one bubble generator 100. As an example, when the washing machine 1 includes a plurality of such water supply pipes 31, the washing machine 1 may generate one bubble generator 100 configured to connect any one of the plurality of water supply pipes 31 to the detergent supply device 80. Otherwise, the washing machine 1 may include a plurality of such bubble generators 100 configured to connect the plurality of water supply pipes 31 to the detergent supply device 80. Here, the number of bubble generators 100 may correspond to the number of water supply pipes 31.

The bubble generator 100 will be described below in detail.

Figure 3:
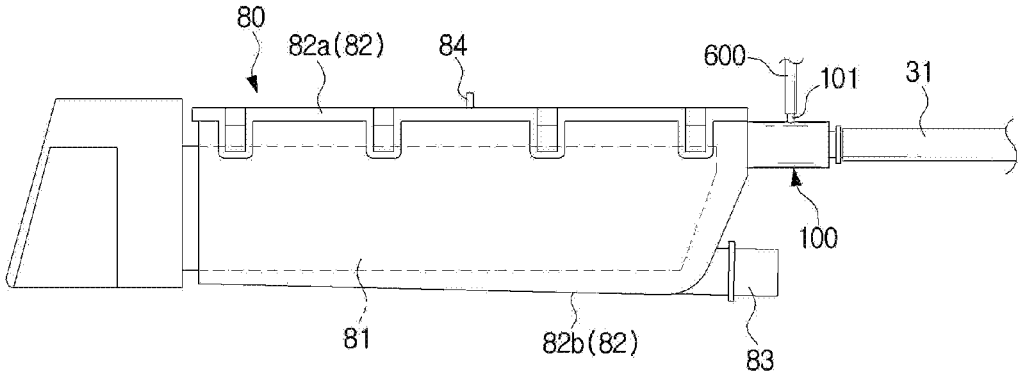
FIG. 3 is a view illustrating the bubble generator according to the first embodiment in the washing machine according to an embodiment of the present disclosure.
Figure 4:
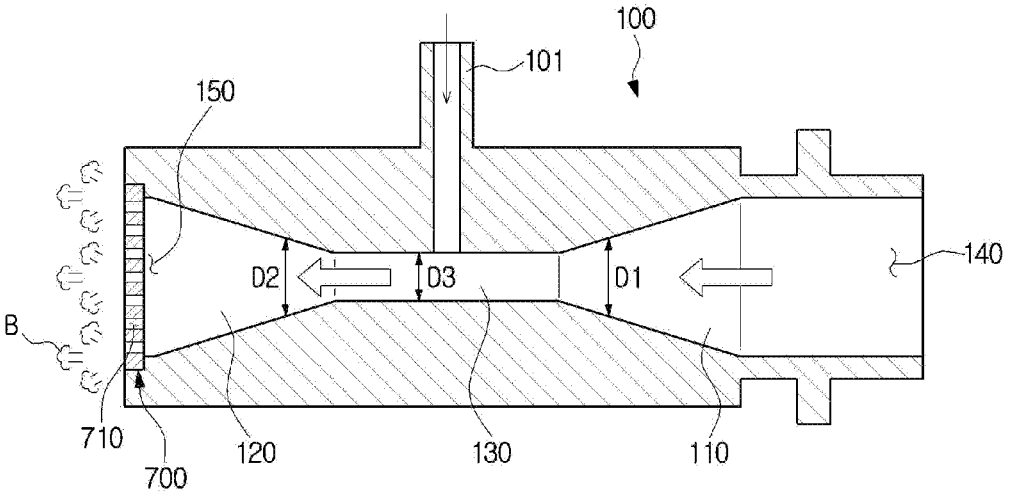
FIG. 4 is a detailed view illustrating the bubble generator according to the first embodiment of FIG. 3.
Figure 5:
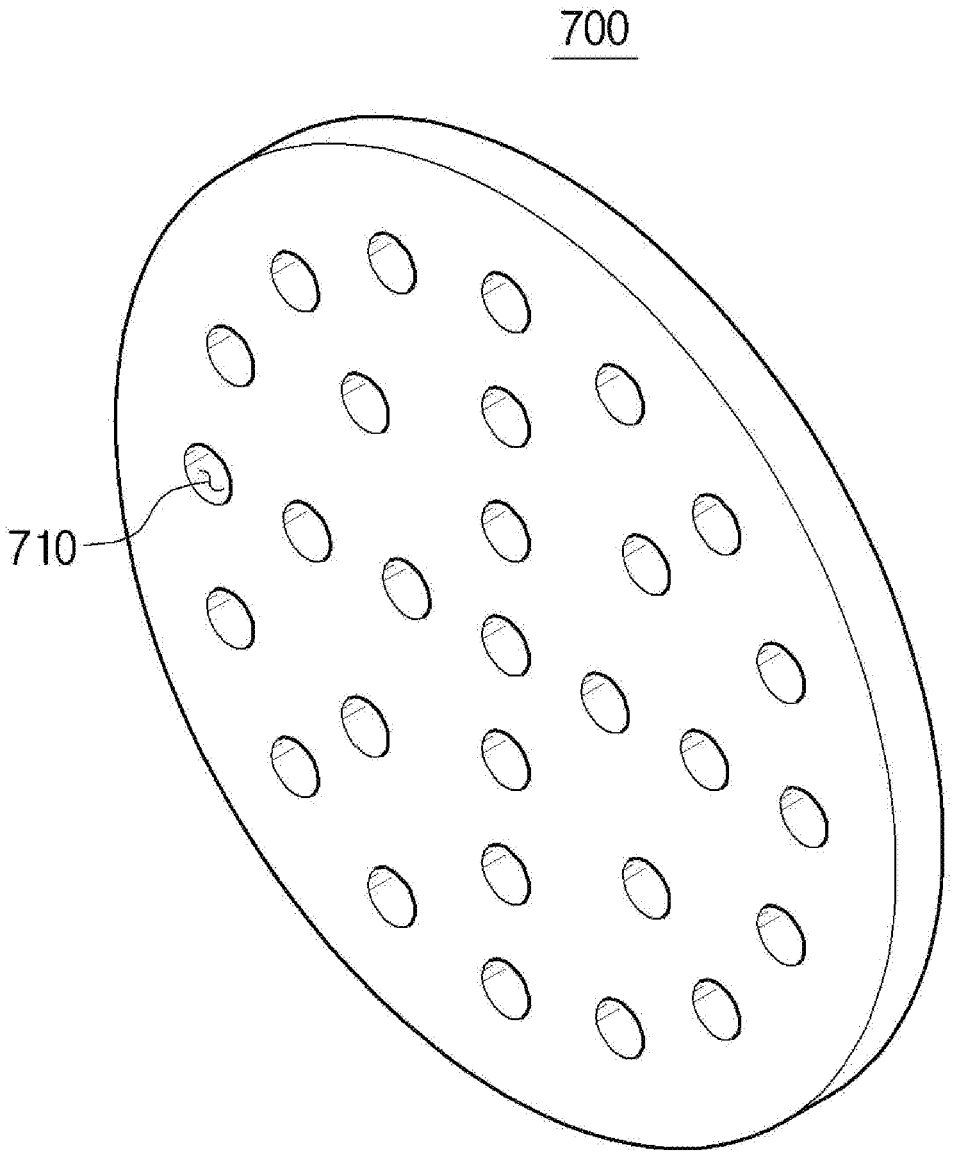
FIG. 5 is an enlarged view illustrating a perforated plate of FIG. 4.

FIG. 3 is a view illustrating the bubble generator according to the first embodiment in the washing machine according to an embodiment of the present disclosure, and FIG. 4 is a detailed view illustrating the bubble generator according to the first embodiment of FIG. 3. FIG. 5 is an enlarged view illustrating a perforated plate of FIG. 4.

As shown in FIGS. 3 to 5, the bubble generator 100 may include a first flow path pipe 110 connected to the water supply pipe 31, a second flow path pipe 120 connected to the detergent supply device 80, and a connection pipe 130 configured to connect the first flow path pipe 110 to the second flow path pipe 120. In detail, the second flow path pipe 120 may be connected to the detergent box housing 82. In more detail, the second flow path pipe 120 may be connected to the detergent box accommodation body 82*b*. The connection pipe 130 may be located between the first flow path pipe 110 and the second flow path pipe 120 and may have a diameter smaller than those of the first flow path pipe 110 and the second flow path pipe 120. As an example, when it is assumed that a diameter of the first flow path pipe 110 at a certain position is referred to as D1, a diameter of the second flow path pipe 120 at a certain position is referred to as D2, and a diameter of the connection pipe 130 at a certain position is referred to as D3, D1 and D2 may be greater than D3. Here, D1 may refer to a smallest part of a diameter of the first flow path pipe 110, and D2 may refer to a smallest part of a diameter of the second flow path pipe 120. The diameter of the first flow path pipe 110 and the diameter of the second flow path pipe 120 may gradually decrease toward the connection pipe 130. The diameter of the first flow path pipe 110 and the diameter of the second flow path pipe 120 may be equal to or different from each other. On the other hand, the diameter of the connection pipe 130 may be relatively uniform. Although the first flow path pipe 110 and the second flow path pipe 120 may have symmetrical structures on the basis of the connection pipe 130, the first flow path pipe 110 and the second flow path pipe 120 may also have asymmetrical structures on the basis of the connection pipe 130.

An inlet 140 and an outlet 150 of the bubble generator 100 may be collinear. As shown in FIG. 4, wash water which flows into the bubble generator 100 through the inlet 140 of the bubble generator 100 changes into bubbles while horizontally flowing, and the bubbles still horizontally flowing pass through the outlet 150 and are discharged outward from the bubble generator 100. That is, the bubbles generated by the bubble generator 100 are supplied to the detergent supply device 80 through the outlet 150.

The bubble generator 100 may further include an air inflow pipe 600 connected to the connection pipe 130 to allow air to flow into the bubble generator 100. In detail, the air inflow pipe 600 may be coupled to a first pipe 101 which protrudes from the bubble generator 100. That is, one end of the air inflow pipe 600 may be opened to allow air to flow therein and the other end of the air inflow pipe 600 may be connected to the bubble generator 100 to supply the air which flows into the air inflow pipe 600 to the bubble generator 100. Otherwise, the air inflow pipe 600 may be configured to connect the detergent supply device 80 to the connection pipe 130. In detail, the air inflow pipe 600 may connect the first pipe 101 configured to protrude from the bubble generator 100 to a second pipe 84 configured to protrude from the detergent supply device 80. Air accommodated in the detergent supply device 80 may flow into the bubble generator 100 through the air inflow pipe 600. Preferably, the air inflow pipe 600 may be configured to connect a top of the detergent supply device 80 to a top of the connection pipe 130. That is, the air inflow pipe 600 may connect the second pipe 84 configured to protrude above the detergent supply device 80 to the first pipe 101 configured to protrude above the connection pipe 130. In other words, the air inflow pipe 600 may connect the second pipe 84 configured to protrude above the detergent box cover 82*a* to the first pipe 101 configured to protrude above the connection pipe 130.

The air inflow pipe 600 may be configured to connect the tub 50 to the connection pipe 130. Air accommodated in the tub 50 may flow into the bubble generator 100 through the air inflow pipe 600.

The bubble generator 100 may further include a perforated plate 700. The perforated plate 700 may be disposed in the bubble generator 100. As an example, the perforated plate 700 may be disposed at the second flow path pipe 120. The perforated plate 700 may include a plurality of openings 710. A shape of the plurality of openings 710 is variously changeable such as a circle, a polygon, and the like. Primary bubbles are formed by interaction between wash water which flows into the bubble generator 100 through the water supply pipe 31 and air which flows into the bubble generator 100 through the air inflow pipe 600, and secondary bubbles are formed as the primary bubbles pass through the perforated plate 700. The secondary bubbles may have a diameter smaller than that of the primary bubbles. Resultantly, the secondary bubbles are supplied to the detergent supply device 80, and wash water is formed by mixing the secondary bubbles with a detergent participates in washing of laundry. The perforated plate 700 forms the secondary bubbles and simultaneously maintains the secondary bubbles in a uniform shape for a certain period of time. At least a part of wash water which flows into the bubble generator 100 through the water supply pipe 31 changes into bubbles having a high energy level as a vortex is generated by a water pressure when water is supplied. Bubbles may allow a detergent to be more easily dissolved and may simultaneously promote activation of wash water particles. The wash water particles activated by the bubbles are directly jetted onto laundry in the drum 60 such that a phenomenon in which laundry is worn out or damaged may be minimized. Also, since the wash water particles generated by the bubbles contain a larger amount of air than pure wash water, laundry may be washed using a relatively less amount of wash water.

The bubble generator 100 may be coupled to the detergent supply device 80.

Also, the bubble generator 100 may be integrated with the detergent supply device 80 as a whole.

Otherwise, the bubble generator 100 may be separably disposed. As an example, the bubble generator 100 may be separably coupled to the detergent supply device 80. As another example, the bubble generator 100 may be separably installed at the water supply pipe 31.

An air flow which flows into the bubble generator 100 through the air inflow pipe 600 and a wash water flow which flows into the bubble generator 100 from the water supply pipe 31 may intersect with each other in the bubble generator 100. In detail, an air flow which flows into the bubble generator 100 through the air inflow pipe 600 and a wash water flow which flows into the bubble generator 100 from the water supply pipe 31 may intersect with each other at the connection pipe 130 of the bubble generator 100.

A position of the bubble generator 100 from a side of a flow path will be described as follows.

The washing machine 1 may further include a first water supply flow path 160 (refer to FIG. 2) located at an upper stream in a direction in which wash water supplied by the water supply device 30 moves. The first water supply flow path 160 may connect the water supply device 30 to the detergent supply device 80.

The washing machine 1 may further include a second water supply flow path 170 (refer to FIG. 2) located at a down stream in a direction in which wash water supplied by the water supply device 30 moves. The second water supply flow path 170 may connect the detergent supply device 80 to the tub 50.

The bubble generator 100 may be disposed at the first water supply flow path 160 to generate bubbles from wash water supplied by the water supply device 30.

The washing machine 1 may further include an air flow path 180 (refer to FIG. 2) configured to connect the detergent supply device 80 to the connection pipe 130 to allow air to flow into the bubble generator 100.

Figure 6:
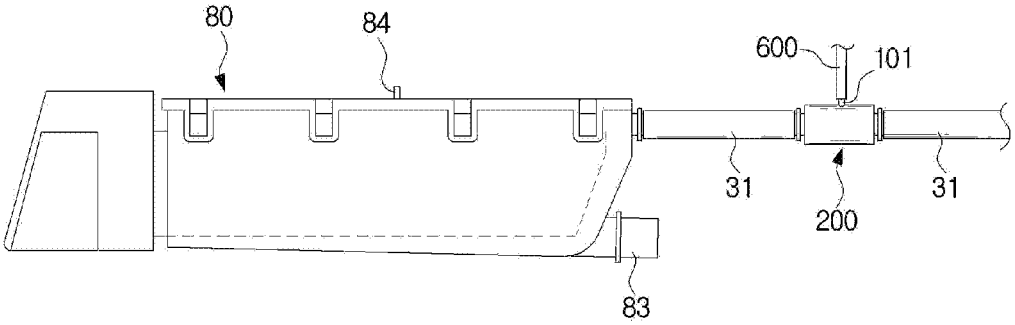
FIG. 6 is a view of a bubble generator according to a second embodiment in the washing machine according to an embodiment of the present disclosure.

FIG. 6 is a view of a bubble generator according to a second embodiment in the washing machine according to an embodiment of the present disclosure. Hereinafter, an overlapped description with respect to the bubble generator 100 according to the first embodiment will be omitted. Hereinafter, undescribed reference numerals will be referred to FIGS. 1 to 5.

As shown in FIG. 6, a bubble generator 200 may be disposed between the water supply device 30 and the detergent supply device 80 in the direction in which wash water supplied by the water supply device 30 moves, in order to generate bubbles from the wash water supplied by the water supply device 30. In detail, the bubble generator 200 may be separably installed at the water supply pipe 31. In more detail, the bubble generator 200 may be separably installed at the water supply pipe 31 to be spaced at a certain interval apart from the detergent supply device 80.

Since a structure of the bubble generator 200 is equal to a structure of the bubble generator 100 according to the first embodiment, a description thereof will be omitted.

Figure 7:
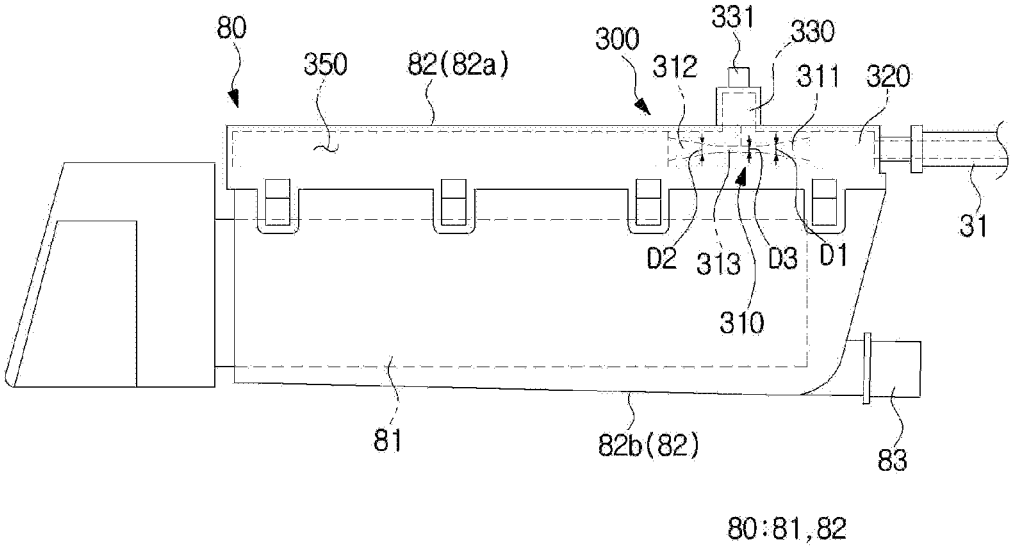
FIG. 7 is a view illustrating a bubble generator according to a third embodiment in the washing machine according to an embodiment of the present disclosure.
Figure 8:
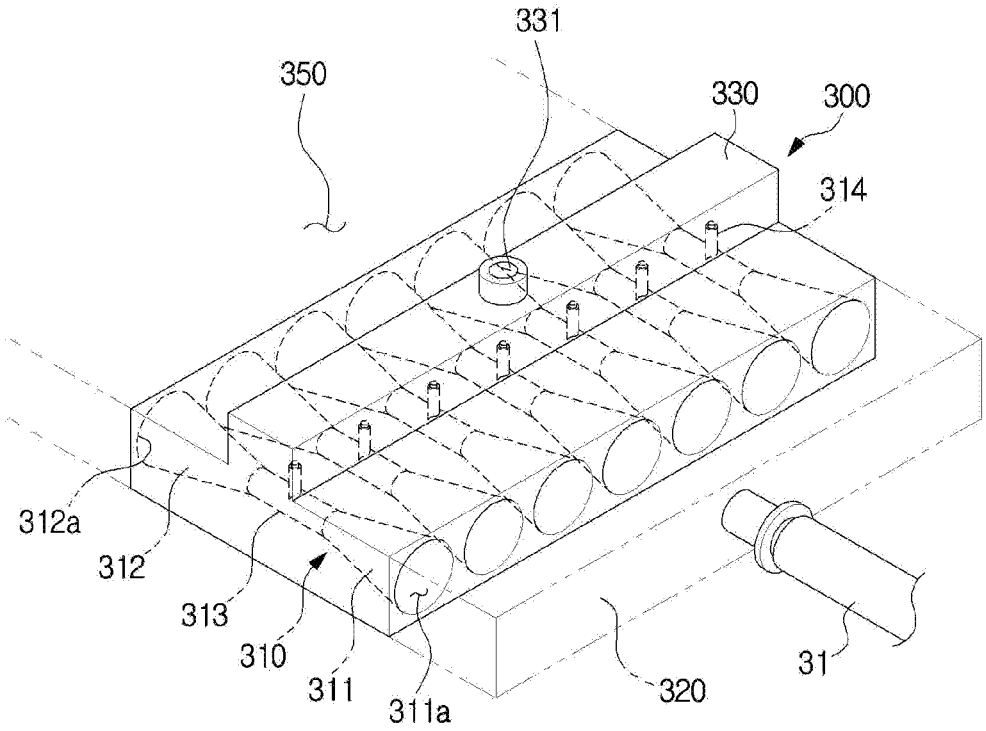
FIG. 8 is a detailed view illustrating the bubble generator according to the third embodiment of FIG. 7.
Figure 9:
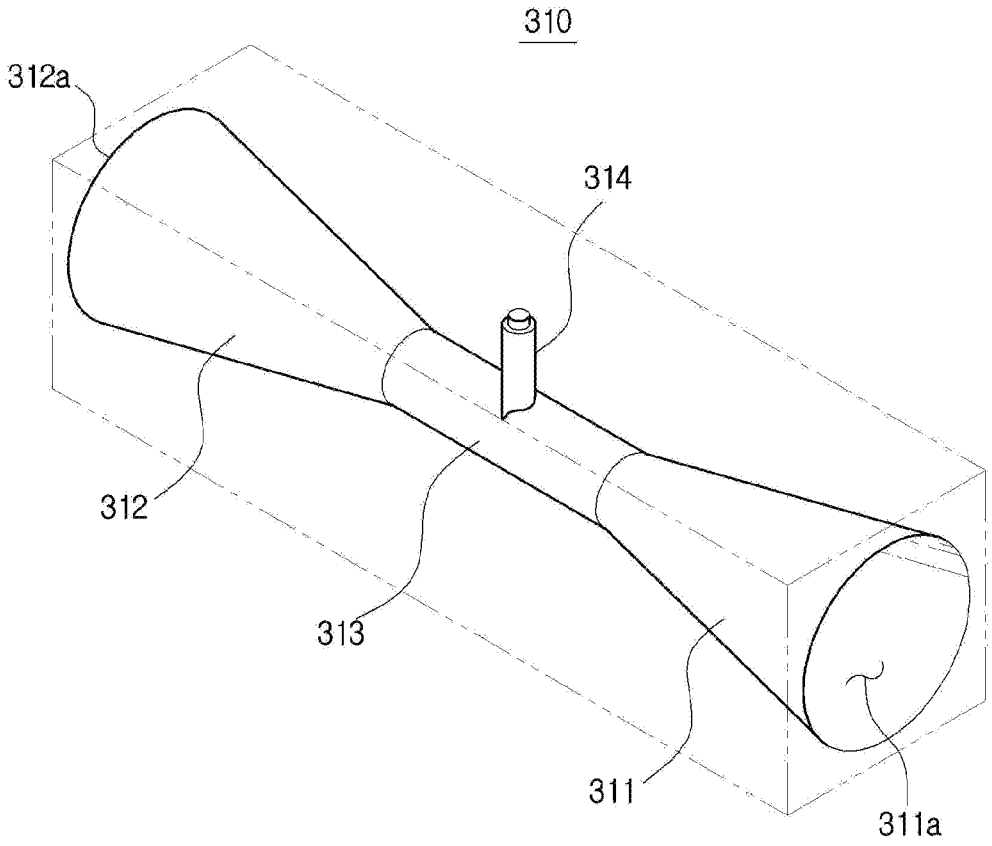
FIG. 9 is an enlarged view illustrating a part of FIG. 8.

FIG. 7 is a view illustrating a bubble generator according to a third embodiment in the washing machine according to an embodiment of the present disclosure, and FIG. 8 is a detailed view illustrating the bubble generator according to the third embodiment of FIG. 7. FIG. 9 is an enlarged view illustrating a part of FIG. 8. Hereinafter, an overlapped description with respect to the bubble generator 100 according to the first embodiment will be omitted. Hereinafter, undescribed reference numerals will be referred to FIGS. 1 to 5.

As shown in FIGS. 7 to 9, a bubble generator 300 may be disposed between the water supply device 30 and the detergent supply device 80 in the direction in which wash water supplied by the water supply device 30 moves, in order to generate bubbles from the wash water supplied by the water supply device 30.

The bubble generator 300 may be disposed above the detergent supply device 80 such that bubbles generated by the bubble generator 300 may fall onto the detergent supply device 80 due to gravity.

The bubble generator 300 may include one or more bubble generation units 310.

The bubble generator 300 may further include a wash water flow path pipe 320 configured to connect the water supply pipe 31 to the one or more bubble generation units 310 in order to supply wash water to the one or more bubble generation units 310. The one or more bubble generation units 310 may be arranged in parallel.

The bubble generator 300 may further include an air flow path pipe 330 disposed above the one or more bubble generation units 310 to supply air to the one or more bubble generation units 310. The air flow path pipe 330 may include an air inlet 331 connected to an air inflow pipe (not shown).

The air inlet 331 may be formed at one surface of the air flow path pipe 330 to protrude upward.

The wash water flow path pipe 320 and the air flow path pipe 330 may be arranged in parallel.

Each of the one or more bubble generation units 310 may include a first flow path pipe 311 through which water supplied by the water supply pipe 31 flows inward. That is, each of the one or more bubble generation units 310 may include the first flow path pipe 311 including an inlet 311*a* configured to communicate with the wash water flow path pipe 320.

Each of the one or more bubble generation units 310 may include a second flow path pipe 312 through which water supplied by the water supply pipe 31 is discharged. That is, each of the one or more bubble generation units 310 may include the second flow path pipe 312 including an outlet 312*a* configured to communicate with the detergent supply device 80. In detail, each of the one or more bubble generation units 310 may include the second flow path pipe 312 including the outlet 312*a* configured to indirectly communicate with the detergent supply device 80. The outlet 312*a* of each of the one or more bubble generation units 310 may communicate with a bubble movement flow path 350. Accordingly, bubbles are generated by interaction between wash water which flows inward through the inlets 311*a* of the one or more bubble generation units 310 and air which flows inward through an air inflow port 314 and flows out toward the bubble movement flow path through the outlets 312*a* of the one ore more bubble generation units 310. The bubbles pass through the bubble movement flow path 350 and then are supplied to the detergent supply device 80, that is, to the detergent box 81.

Each of the one or more bubble generation units 310 may further include a connection pipe 313 configured to connect the first flow path pipe 311 to the second flow path pipe 312. The connection pipe 313 may have a diameter smaller than those of the first flow path pipe 311 and the second flow path pipe 312. As an example, when it is assumed that a diameter of the first flow path pipe 311 at a certain position is referred to as D1, a diameter of the second flow path pipe 312 at a certain position is referred to as D2, and a diameter of the connection pipe 313 at a certain position is referred to as D3, D1 and D2 may be greater than D3. Here, D1 may refer to a smallest part of a diameter of the first flow path pipe 311, and D2 may refer to a smallest part of a diameter of the second flow path pipe 312. The diameter of the first flow path pipe 311 and the diameter of the second flow path pipe 312 may gradually decrease toward the connection pipe 313. The diameter of the first flow path pipe 311 and the diameter of the second flow path pipe 312 may be equal to or different from each other. On the other hand, the diameter of the connection pipe 313 may be relatively uniform. Although the first flow path pipe 311 and the second flow path pipe 312 may have symmetrical structures on the basis of the connection pipe 313, the first flow path pipe 311 and the second flow path pipe 312 may also have asymmetrical structures on the basis of the connection pipe 313.

The inlets 311*a* and the outlets 312*a* of the one or more bubble generation units 310 may be collinear.

Each of the one or more bubble generation units 310 may further include the air inflow port 314 configured to communicate with the air flow path pipe 330 to allow air to flow into the one or more bubble generation units 310. In other words, each of the one or more bubble generation units 310 may further include the air inflow port 314 configured to communicate with the connection pipe 313. The air inflow port 314 may connect the air flow path pipe 330 to the connection pipe 313 of each of the one or more bubble generation units 310. Accordingly, air in the air flow path pipe 330 passes through the air inflow port 314 and flows into the connection pipe 313 of each of the one or more bubble generation units 310.

The one or more bubble generation units 310 may be arranged in a longitudinal direction of the wash water flow path pipe 320 and the air flow path pipe 330.

The bubble generator 300 may further include a bubble movement flow path 305 located at a down stream of the one or more bubble generation units 310 in a direction in which wash water supplied by the water supply device 30 moves. The bubble movement flow path 350 may communicate with the outlet 312*a* of each of the one or more bubble generation units 310.

The bubble generator 300 may further include one or more perforated plates 700 disposed in the one or more bubble generation units 310 and configured to include a plurality of openings 710. As an example, the one or more perforated plates 700 may be arranged in the one or more bubble generation units 310 to be adjacent to the outlets 312*a* of the one or more bubble generation units 310. That is, the one or more perforated plates 700 may be arranged at the second flow path pipe 312 of the one or more bubble generation units 310. A shape of the plurality of openings 710 is variously changeable such as a circle, a polygon, and the like.

The bubble generator 300 includes one bubble generation unit 310, the one or more perforated plates 700 may be arranged in the bubble generation unit 310.

When the bubble generator 300 includes a plurality of such bubble generation units 310, the one or more perforated plates 700 may be arranged in some bubble generation units 310 and may not be arranged in the other bubble generation units 310.

An arrangement structure of the one or more perforated plates 700 is not limited to the above example and is variously changeable.

The bubble generator 300 will be described in another aspect as follows.

The detergent supply device 80 may be disposed between the water supply device 30 and the tub 50 in a direction in which wash water supplied by the water supply device 30 moves, in order to supply a detergent to the tub 50. The detergent supply device 80 may include the detergent box 81 configured to accommodate a detergent and the detergent box housing configured to accommodate the detergent box 81. The detergent box housing 82 may include the detergent box accommodation body 82*b* in which the detergent box 81 is accommodated to be withdrawable and the detergent box cover 82*a* coupled to the detergent box accommodation body 82*b*. The detergent box accommodation body 82*b* and the detergent box cover 82*a* may be coupled to each other to form a detergent box accommodation space in which the detergent box 81 can be accommodated. The detergent box cover 82*a* may be coupled to the detergent box accommodation body 82*b* to be located above the detergent box accommodation body 82*b*. The detergent box cover 82*a* may be separably coupled to the detergent box accommodation body 82*b*.

The bubble generator 300 may include the one or more bubble generation units 310. The one or more bubble generation units 310 may be arranged in the detergent box cover 82*a*.

The bubble generator 300 may further include the bubble movement flow path 350 located at a down stream of the one or more bubble generation units 310 in a direction in which wash water supplied by the water supply device 30 moves. The bubble movement flow path 350 may be formed in the detergent box cover 82*a* to be located at the down stream of the one or more bubble generation units 310 in the direction in which wash water supplied by the water supply device 30 moves.

Accordingly, bubbles discharged from the one or more bubble generation units 310 move along the bubble movement flow path 350 and then are supplied to the detergent box 81 of the detergent supply device 80.

Figure 10:
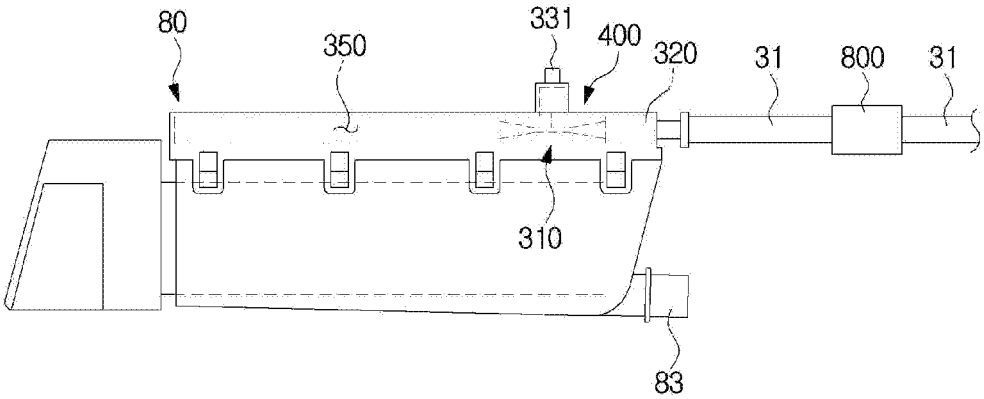
FIG. 10 is a view of a bubble generator according to a fourth embodiment in the washing machine according to an embodiment of the present disclosure.

FIG. 10 is a view of a bubble generator according to a fourth embodiment in the washing machine according to an embodiment of the present disclosure. Hereinafter, an overlapped description with respect to the bubble generator 300 according to the third embodiment will be omitted. Hereinafter, undescribed reference numerals will be referred to FIGS. 7 to 9. Hereinafter, the reference numeral "400" refers to the bubble generator according to the fourth embodiment.

As shown in FIG. 10, the washing machine 1 may further include a water pressure increasing device 800. The water pressure increasing device 800 may be installed at the water supply pipe 31 to increase a water pressure of wash water which flows into the one or more bubble generation units 310. However, a position of the water pressure increasing device 800 is not limited to the water supply pipe 31 and is variously changeable. In detail, it is sufficient when the water pressure increasing device 800 is located on an upper stream side than the one or more bubble generation unit 310 in a direction in which wash water supplied by the water supply device 30 moves. As an example, the water pressure increasing device 800 may be installed at the wash water flow path pipe 320 as well as the water supply pipe 31.

The water pressure increasing device 800 may include a pump configured to increase a water pressure of wash water which flows into the one or more bubble generation units 310.

Figure 11:
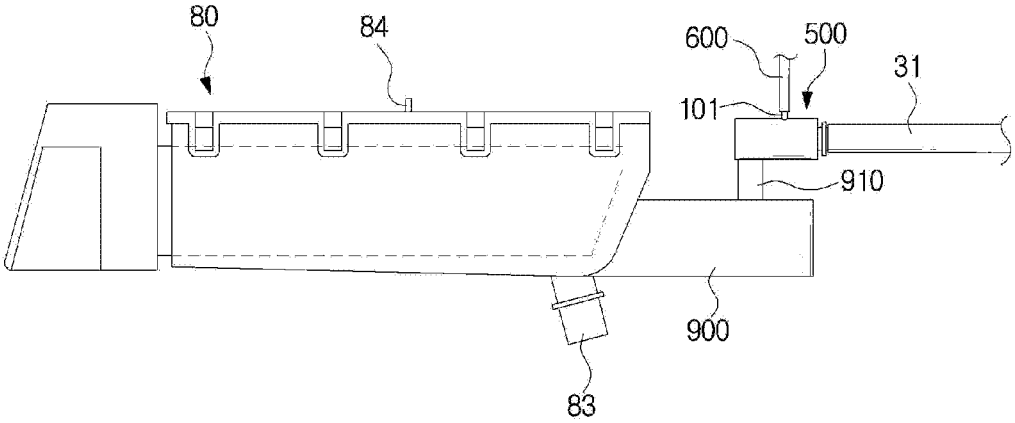
FIG. 11 is a view illustrating a bubble generator according to a fifth embodiment in the washing machine according to an embodiment of the present disclosure.
Figure 12:
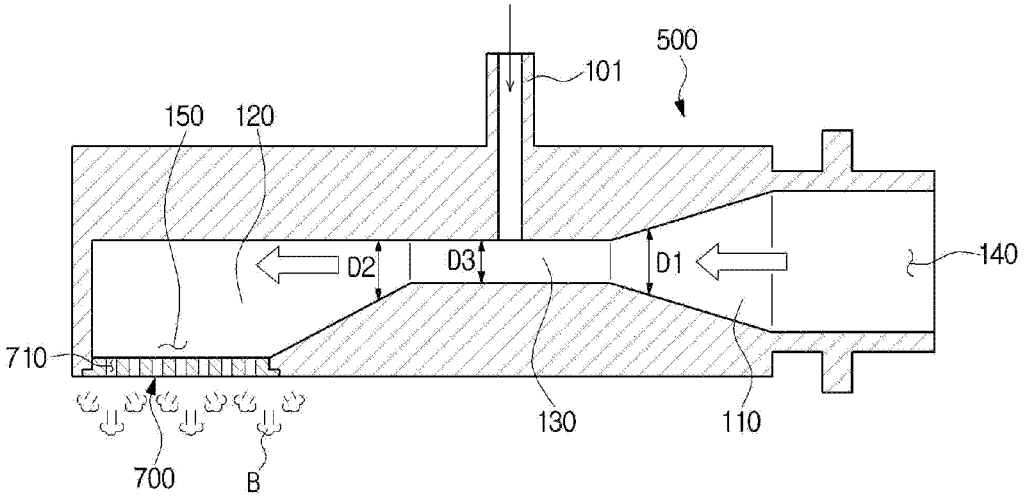
FIG. 12 is a detailed view illustrating a bubble generator according to the fifth embodiment of FIG. 11.

FIG. 11 is a view illustrating a bubble generator according to a fifth embodiment in the washing machine according to an embodiment of the present disclosure, and FIG. 12 is a detailed view illustrating a bubble generator according to the fifth embodiment of FIG. 11. Hereinafter, an overlapped description with respect to the bubble generator 100 according to the first embodiment will be omitted. Hereinafter, undescribed reference numerals will be referred to FIGS. 1 to 5.

As shown in FIGS. 11 and 12, the washing machine 1 may further include a bubble storage tank 900 disposed between a bubble generator 500 and the detergent supply device 80 in a direction in which wash water supplied by the water supply device 30 moves, in order to store bubbles generated by the bubble generator 500. The bubbles generated by the bubble generator 500 are not directly supplied to the detergent supply device 80 and pass through the bubble storage tank 900 and then are supplied to the detergent supply device 80. When the bubble storage tank 900 is installed, it is possible to secure an adequate space capable of accommodating the bubbles generated by the bubble generator 500. The bubble generator 500 and the bubble storage tank 900 are connected to each other by a connection pipe 910.

The bubble generator 500 may include a first flow path pipe 510 connected to the water supply pipe 31, a second flow path pipe 520 connected to the bubble storage tank 900, and a connection pipe 530 configured to connect the first flow path pipe 510 to the second flow path pipe 520. The connection pipe 530 may be located between the first flow path pipe 510 and the second flow path pipe 520 and may have a diameter smaller than those of the first flow path pipe 510 and the second flow path pipe 520. As an example, when it is assumed that a diameter of the first flow path pipe 510 at a certain position is referred to as D1, a diameter of the second flow path pipe 520 at a certain position is referred to as D2, and a diameter of the connection pipe 530 at a certain position is referred to as D3, D1 and D2 may be greater than D3. Here, D1 may refer to a smallest part of a diameter of the first flow path pipe 510, and D2 may refer to a smallest part of a diameter of the second flow path pipe 520. The diameter of the first flow path pipe 510 and the diameter of the second flow path pipe 520 may gradually decrease toward the connection pipe 530. The diameter of the first flow path pipe 510 and the diameter of the second flow path pipe 520 may be equal to or different from each other. On the other hand, the diameter of the connection pipe 530 may be relatively uniform. Although the first flow path pipe 510 and the second flow path pipe 520 may have asymmetrical structures on the basis of the connection pipe 530, the first flow path pipe 510 and the second flow path pipe 520 may also have symmetrical structures on the basis of the connection pipe 530.

An inlet 540 and an outlet 550 of the bubble generator 500 may not be collinear. As shown in FIG. 12, wash water, which flows into the bubble generator 500 through the inlet 540 of the bubble generator 500, changes into bubbles while horizontally flowing, and the bubbles pass through the outlet 550 and are vertically discharged outward from the bubble generator 500. That is, the bubbles generated by the bubble generator 500 fall in a direction of gravity through the outlet 550 and are temporarily stored in the bubble storage tank 900.

The bubble generator 500 may further include a perforated plate 700. The perforated plate 700 may be disposed in the bubble generator 500. As an example, the perforated plate 700 may be disposed at the second flow path pipe 520. Preferably, the perforated plate 700 may be disposed at the outlet 550 of the bubble generator 500. The perforated plate 700 may include a plurality of openings 710. A shape of the plurality of openings 710 is variously changeable such as a circle, a polygon, and the like.

Figure 13:
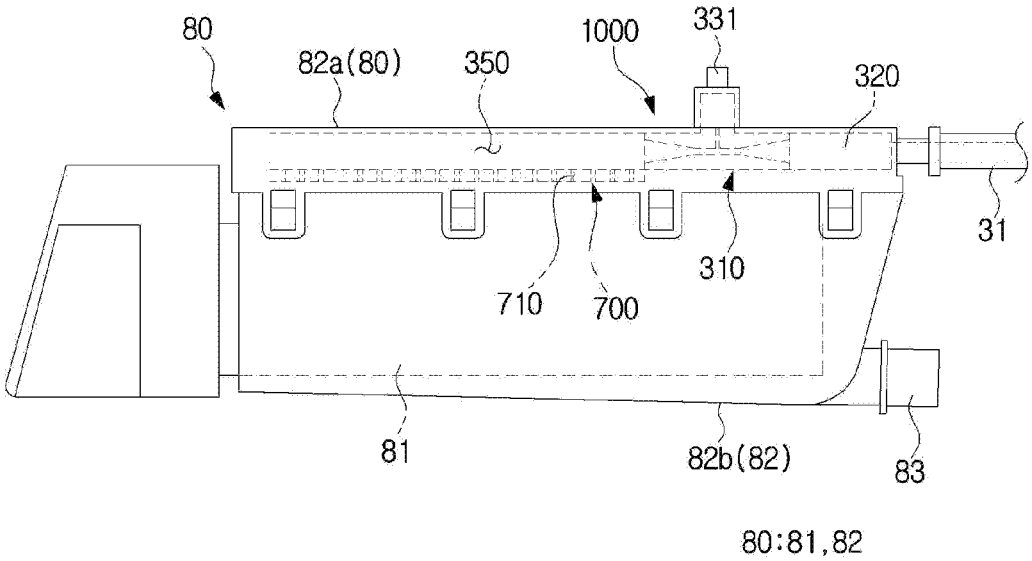
FIG. 13 is a view of a bubble generator according to a sixth embodiment in the washing machine according to an embodiment of the present disclosure.

FIG. 13 is a view of a bubble generator according to a sixth embodiment in the washing machine according to an embodiment of the present disclosure. Hereinafter, an overlapped description with respect to the bubble generator 300 according to the third embodiment will be omitted. Hereinafter, undescribed reference numerals will be referred to FIGS. 7 to 9.

As shown in FIG. 13, the bubble generator 1000 may be disposed between the water supply device 30 and the tub 50 in a direction in which wash water supplied by the water supply device 30 moves.

The bubble generator 1000 may be disposed at a top of the detergent supply device 80. In detail, the bubble generator 1000 may be disposed at a top of the detergent box housing 82. In more detail, the bubble generator 100 may be disposed at the detergent box cover 82*a*.

The bubble generator 1000 may include the perforated plate 700 disposed in the detergent box cover 82*a*. The perforated plate 700 may be disposed at the bubble movement flow path 350 such that wash water, which passes through the one or more bubble generation units 310 and reaches the bubble movement flow path 350, may pass through the perforated plate 700 and flow into the detergent box 81.

As shown in FIG. 13, the perforated plate 700 may be disposed at one wall or one side of the detergent box cover 82*a*. That is, the perforated plate 700 may be disposed at an inner surface of one wall of the detergent box cover 82*a* configured to face the detergent box accommodation body 82*b*.

The perforated plate 700 may be integrated with one wall of the detergent box cover 82*a*. That is, the perforated plate 700 may be integrated with one wall of the detergent box cover 82*a* configured to face the detergent box accommodation body 82*b*. In this case, the one wall of the detergent box cover 82*a* may be embodied as the perforated plate 700. Accordingly, the wash water, which passes through the one or more bubble generation units 310 and reaches the bubble movement flow path 350, may change into micro bubbles while passing through the detergent box cover 82*a*, which functions as the perforated plate 700, and flowing into the detergent box 81.

As is apparent from the above description, a bubble generator is disposed between a water supply device and a detergent supply device in a direction in which wash water supplied from the water supply device moves such that all the wash water supplied from the water supply device may be bubbled and may be supplied to a tub regardless of a type of washing operation.

The bubble generator is applied to a washing machine such that washing performance may be improved without damaging laundry.

The laundry may be washed with a relatively small amount of water by using bubbles generated by the bubble generator.

Solubility of a detergent may be increased using bubbles during a washing process such that the detergent may be uniformly supplied to the laundry.

The bubble generator is disposed between the water supply device and the detergent supply device in the direction in which the wash water supplied by the water supply device moves such that a detergent box of the detergent supply device may be cleaned using bubbles.

The bubble generator is disposed between the water supply device and the detergent supply device in the direction in which the wash water supplied by the water supply device moves such that a drum and the tub, in detail, a space between the drum and the tub may be cleaned using bubbles.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A washing machine comprising:

a detergent box configured to store a detergent;

a detergent box housing configured to accommodate the detergent box therein, the detergent box housing comprising an air outflow pipe configured to protrude therefrom;

a water supply pipe configured to supply water to the detergent box;

a bubble generator disposed between the water supply pipe and the detergent box housing and configured to generate bubbles to be supplied to the detergent box by mixing water with air, the bubble generator comprising:

a first flow path pipe connected to the water supply pipe;

a second flow path pipe connected to the detergent box housing;

a connection pipe configured to connect the first flow path pipe to the second flow path pipe and to have a diameter smaller than diameters of the first flow path pipe and the second flow path pipe; and an air inflow pipe having one end connected to the connection pipe and an other end connected to the air outflow pipe of the detergent box housing so that air accommodated in the detergent box housing flows into the bubble generator through the air outflow pipe and the air inflow pipe.

2. The washing machine of claim 1, wherein the bubble generator further comprises a perforated plate disposed at the second flow path pipe.

3. The washing machine of claim 1, wherein the bubble generator is disposed above the detergent box housing.

4. The washing machine of claim 3, wherein the washing machine comprises a plurality of bubble generators and the bubble generator is one of the plurality of bubble generators, and the plurality of bubble generators are arranged in parallel.

5. The washing machine of claim 3, wherein the detergent box housing comprises:

a detergent box accommodation body in which the detergent box is insertable to the detergent box accommodation body and withdrawable from the detergent box accommodation body; and a detergent box cover coupled to a top of the detergent box accommodation body, and wherein the bubble generator comprises a perforated plate disposed at one side of the detergent box cover to face the detergent box accommodation body.

6. The washing machine of claim 3, further comprising a water pressure increasing device configured to increase water pressure of the water supplied to the bubble generator.

7. A washing machine comprising:

a tub;

a water supply device configured to supply wash water to the tub;

a detergent supply device configured to supply a detergent to the tub, the detergent supply device comprising an air outflow pipe configured to protrude therefrom;

a first water supply flow path located on an upper stream side in a direction, in which the wash water supplied by the water supply device moves, and configured to connect the water supply device to the detergent supply device;

a second water supply flow path located on a downstream side in the direction, in which the wash water supplied by the water supply device moves, and configured to connect the detergent supply device to the tub; and a bubble generator disposed at the first water supply flow path to generate bubbles using the wash water supplied by the water supply device, the bubble generator comprising:

a first flow path pipe connected to the water supply pipe;

a second flow path pipe connected to the detergent supply device;

a connection pipe configured to connect the first flow path pipe to the second flow path pipe and to have a diameter smaller than diameters of the first flow path pipe and the second flow path pipe; and an air inflow pipe having one end connected to the connection pipe and an other end connected to the air outflow pipe of the detergent supply device so that air accommodated in the detergent supply device flows into the bubble generator through the air outflow pipe and the air inflow pipe.

8. The washing machine of claim 7, wherein the bubble generator further comprises a perforated plate disposed in the bubble generator and configured to comprise a plurality of openings.

9. The washing machine of claim 7, wherein the bubble generator is separably disposed.

10. A washing machine comprising:

a tub;

a water supply device configured to supply wash water to the tub;

a detergent supply device disposed between the water supply device and the tub in a direction in which the wash water supplied by the water supply device moves, to supply a detergent to the tub, configured to comprise a detergent box in which the detergent is accommodated, and comprising an air outflow pipe configured to protrude therefrom;

a detergent box accommodation body configured to accommodate the detergent box;

a detergent box cover coupled to the detergent box accommodation body; and a bubble generator disposed between the water supply device and the detergent supply device in the direction in which the wash water supplied by the water supply device moves, to generate bubbles using the wash water supplied by the water supply device, and configured to comprise one or more bubble generation units arranged in the detergent box cover wherein the bubble generator comprises:

a first flow path pipe connected to the water supply pipe;

a second flow path pipe connected to the detergent supply device;

a connection pipe configured to connect the first flow path pipe to the second flow path pipe and to have a diameter smaller than diameters of the first flow path pipe and the second flow path pipe; and an air inflow pipe having one end connected to the connection pipe and an other end connected to the air outflow pipe of the detergent supply device so that air accommodated in the detergent supply device flows into the bubble generator through the air outflow pipe and the air inflow pipe.

* * * * *